United States Patent [19]

Benjamin

[11] 4,168,555

[45] Sep. 25, 1979

[54] WATER MATTRESS WITH DAMPENING CONSTRUCTION

[75] Inventor: Gary L. Benjamin, Mount Blanchard, Ohio

[73] Assignee: Kuss Corporation, Findlay, Ohio

[21] Appl. No.: 894,105

[22] Filed: Apr. 6, 1978

[51] Int. Cl.[2] ..... A47C 27/08

[52] U.S. Cl. ..... 5/452; 152/415

[58] Field of Search ..... 5/367, 368, 349, 350, 5/369, 370, 365, 341, 371; 137/223; 152/415, 429; 297/DIG. 3

[56] References Cited

U.S. PATENT DOCUMENTS

| | | | |
|---|---|---|---|
| 2,691,179 | 10/1954 | Kann | 5/367 |
| 2,826,767 | 3/1958 | Edwards | 5/341 |
| 2,964,084 | 12/1960 | Tubbs | 152/429 |
| 3,748,669 | 7/1973 | Warner | 5/368 |
| 3,864,768 | 2/1975 | Fraige et al. | 5/371 |
| 4,079,473 | 3/1978 | Phillips | 5/367 |

*Primary Examiner*—Mervin Stein
*Assistant Examiner*—Alexander Grosz
*Attorney, Agent, or Firm*—David D. Murray

[57] ABSTRACT

A water mattress having a portion of its volume occupied by air or gas filled bodies lowers the total mattress weight without sacrificing its desirable characteristics. The gas filled bodies comprise independent, elongate, parallel chambers having sidewall members which are secured to the bottom panel of the mattress. The chambers are positioned at approximately the horizontal midplane of the mattress such that it exhibits the conventional uniform weight distribution characteristics found desirable in such devices. Air is supplied to or released from the chambers through access fittings on the chambers and water mattress. The water filled mattress weighs substantially less than a conventional mattress having the same external volume. Furthermore, the chambers tend to inhibit the sloshing and highly under-damped natural harmonic motion typical of conventional water mattresses.

11 Claims, 7 Drawing Figures

FIG. 1
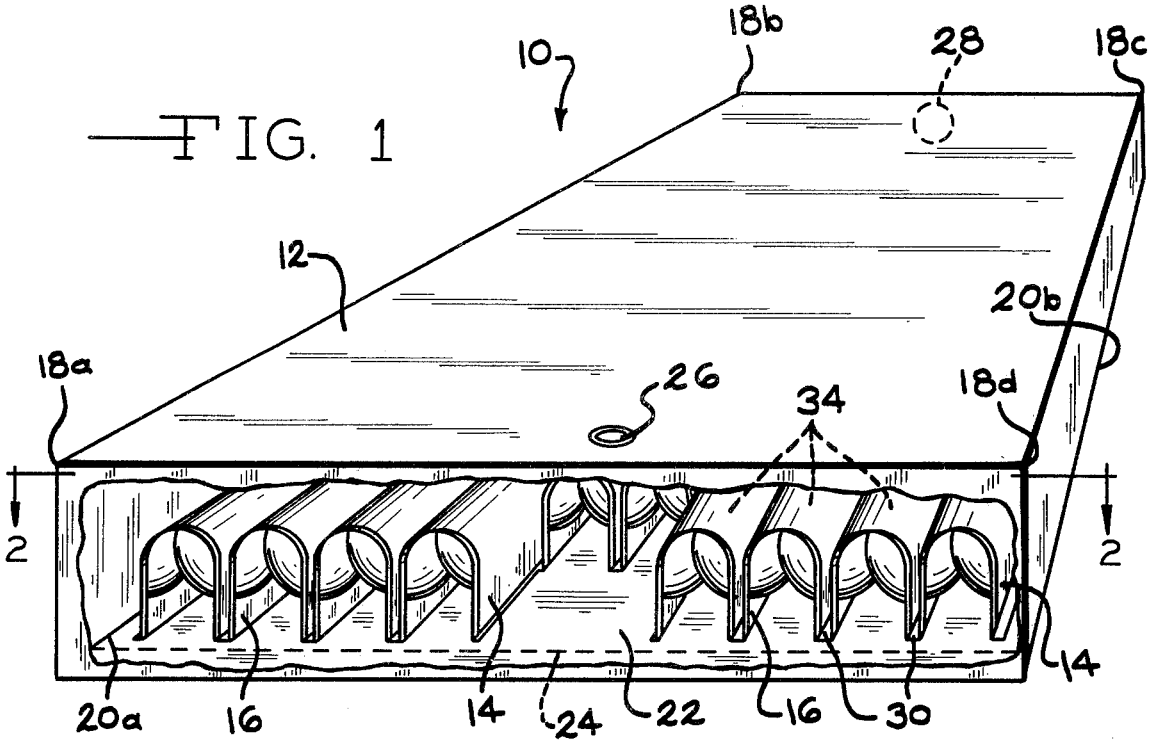
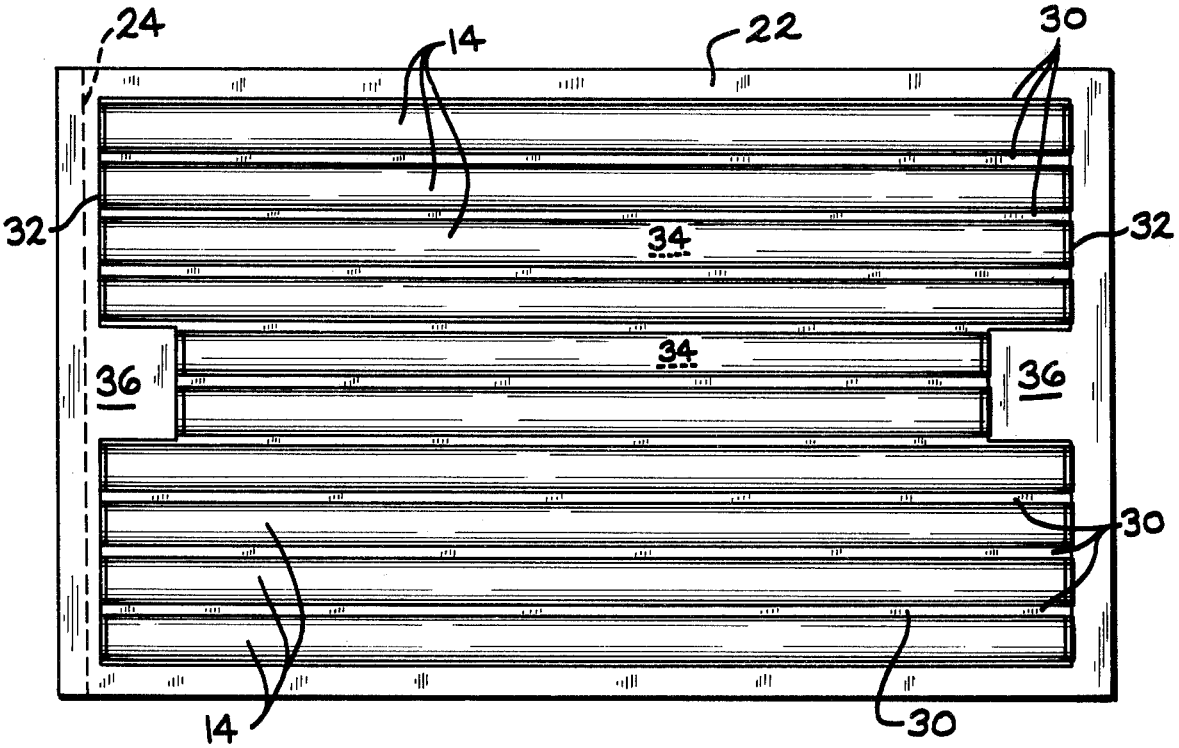
FIG. 2

WATER MATTRESS WITH DAMPENING CONSTRUCTION

BACKGROUND OF THE INVENTION

The instant invention relates generally to water mattresses and more specifically to water mattresses having gas filled chambers substantially fixedly secured within the water mattress.

Within the last decade, water mattresses have progressed from a diversion to an acceptable alternative to a conventional inner spring or foam mattress. Whereas early designs were prone to premature and catastrophic failure caused by rupture of the plastic mattress wall and loss of the water contained therein, improved materials, sophisticated designs and better manufacturing techniques have increased the service life of such mattresses to the point where failure of the plastic mattress wall is uncommon indeed.

Certain characteristics of water mattresses have, however, inhibited even wider acceptance. The foremost problem is weight. A 72 inch by 84 inch by 9 inch king size mattress contains in excess of 31 cubic feet of water which weighs nearly 2,000 pounds. It is apparent why cautious home owners have been discouraged from purchasing such mattresses. It is even more apparent why equally cautious landlords have prohibited the use of such mattresses in their leaseholds. Attempts to minimize the weight of water mattresses have met with little success. Clearly the area of a given mattress is a constraint and thus only the thickness can be diminished. However, it has been determined that a mattress thickness of less than approximately 9 inches may render them uncomfortable under certain circumstances.

A second detrimental characteristic of water mattresses is a subjective aversion to the natural harmonic or wave motion exhibited by a mattress completely filled with water. Subjected to one or a series of excitation impulses, a water mattress will exhibit decaying simple harmonic wave motion which many users find objectionable. Various approaches have been used to damp the wave motion but they have been relatively unsuccessful. Internal baffles have been placed within a mattress but they frequently generate sloshing noises. The cost of manufacturing an internally baffled mattress also militates against such a design. The use of viscous fluids such as gelatins or mud has also been suggested but their use substantially negatives the generally simple drainage procedure and portability benefits associated with such mattresses.

SUMMARY OF THE INVENTION

The instant invention comprises a water mattress having a plurality of longitudinally extending air chambers generally secured to the lower planar surface of the mattress. The overall shape of the mattress is conventional. Internally, however, the air chambers occupy a substantial portion of the volume occupied by water in a conventional water mattress. The total or filled weight of a water mattress according to the instant invention may be as little as one half the weight of a conventional mattress although of the same external dimensions. Secondly, the gas chambers are secured to and float within the filled water mattress at approximately the horizontal midplane thereof. Thus they absorb the harmonic wave energy induced into the water by excitation pulses and damp what would otherwise be the slowly decaying simple harmonic motion of the water contained within the water mattress.

In the preferred embodiment, each of the gas chambers is formed from a unitary folded plastic panel sealed along its edges and repeatedly transversely pleated and sealed to form the gas chambers.

In the preferred and alternate embodiments, each of the gas chambers may be individually filled to a desired independent low pressure to provide somewhat variable characteristics of motion damping and softness to the filled water mattress.

Alternate embodiments of the instant invention comprise generally cylindrical chambers secured to the bottom surface of the water mattress by both a single and a double plastic band.

The invention also comprehends using either of the above structural embodiments with a self contained air charging or gas generation device. A separate air or gas device is sealed into each of the substantially evacuated longitudinal chambers during manufacture. During set up, the device is manually activated to fill the chamber to an exact predetermined pressure.

Thus it is an object of this invention to provide a water mattress having external dimensions equivalent to standard water mattresses but which weighs substantially less than such mattresses.

It is a further object of the instant invention to provide a water mattress including means which damp the harmonic or wave motion characteristic of such water mattress.

It is a further object of the instant invention to provide a water mattress having internal air chambers which are independently inflatable and collapsible to adjust the overall resiliency and damping characteristics of the water mattress.

It is a still further object of the instant invention to provide a water mattress having wave damping chambers which include charging means capable of filling said chambers to a predetermined pressure.

Other objects and advantages of the invention will become apparent from the following detailed description, with reference being made to the accompanying drawings.

BRIEF DESCRIPTION OF THE DRAWINGS

FIG. 1 is a perspective view of a water mattress according to the instant invention with an end panel broken away;

FIG. 2 is a plan view of a water mattress according to the instant invention taken along 2—2 of FIG. 1;

DESCRIPTION OF THE PREFERRED EMBODIMENT

Figure 3:
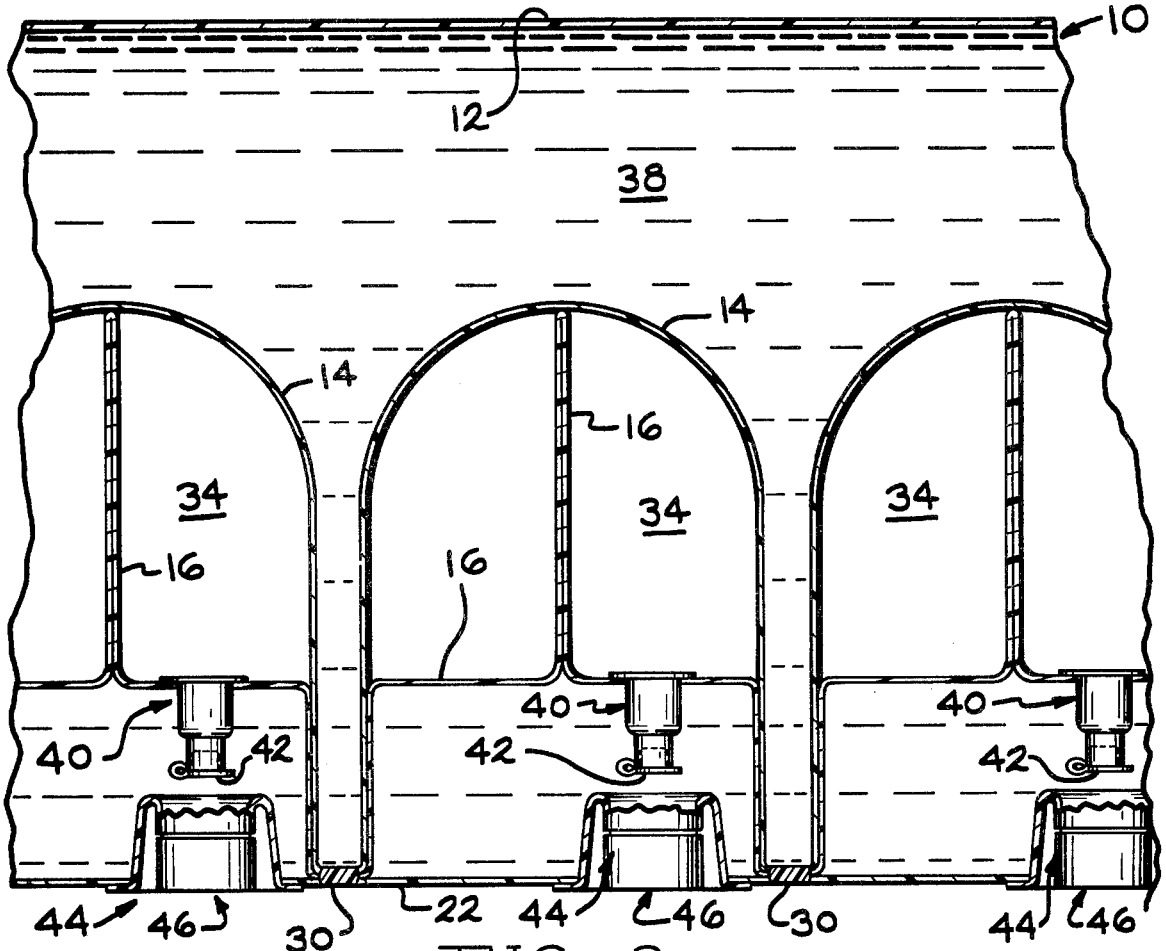
FIG. 3 is an enlarged, fragmentary, end sectional view of a water mattress according to the instant invention.

In FIG. 1, a water mattress of the preferred embodiment is generally designated by the reference numeral 10. The water mattress 10 comprises three plastic panels identified by the numerals 12, 14 and 16.

The unitary panel 12 forms the outer surface of the water mattress 10 which is constructed according to the teachings of my issued U.S. Pat. No. 4,100,634. Basically, the width of the panel 12 is the width of the water mattress 10 plus two times the height of the water mattress. The length of the panel 12 is two times the length of the water mattress plus two times the height. At each vertical corner 18A, 18B, 18C and 18D, the adjacent panels are overlapped and sealed by the application of radio frequency energy. The remaining seams of the water mattress 10 form a generally "H" shaped pattern in the bottom plane of the mattress 10. Here, as in my above-referenced U.S. patent, adjacent vertical and horizontal panels are sealed along two longitudinal seams 20A and 20B.

A bottom panel 22 is formed from folded portions of the panel 12 and is rendered complete by sealing along a transverse seam 24. In the instant invention, the seam 24 is adjacent one end of the water mattress 10. (This is in distinction to the seam placement in my referenced patent in which the seam is placed at approximately the midline of the bottom panel.) This location of the seam 24 is preferred in order to avoid multiple (i.e., four) layer seams resulting from the attachment of the gas chamber assembly, which will be described subsequently.

The upper portion of the panel 12 of the water mattress 10 also includes a fill assembly 26. The fill assembly 26 may consist of a small cappable or threaded fitting through which water may be added or removed from the water mattress 10 in a conventional fashion. Finally, the panel 12 includes a small patch 28 which covers and seals an access opening in the water mattress 10 which facilitates the sealing of the various seams during manufacture of the mattress 10.

Referring now to FIGS. 1 and 2, the bottom panel 22 having the transverse seam 24 is illustrated. The panels 14 and 16 are sealed to the bottom panel 22 along longitudinal seams 30 which extend substantially the full length of the bottom panel 22. The panels 14 and 16 are also sealed together along the transverse edges 32 such that sealed chambers 34 are produced. Preferably, a queen size water mattress will include ten of the chambers 34, whereas, a king size water mattress will include twelve of the chambers 34. The notched portions 36 at both ends of the panels 14 and 16 merely serve to assist the filling of the water mattress with water by preventing the panels 14 and 16 and chambers 34 from obstructing the fill assembly 26.

Referring now to FIG. 3, a means for filling the chambers 34 is illustrated. The water mattress 10 is shown filled with water 38. The chambers 34 are filled with air or other gas. Communicating between each chamber 34 and its exterior is a filler plug assembly 40. The filler plug assembly 40 is secured to the panel 16 and includes a manually insertable and removable plug or cap means 42. The cap means 42 is a friction fit within the plug assembly 40 and it may be removed to allow air into or out from the chamber 34. Coaxially aligned with the plug assembly 40 is a somewhat larger access assembly 44. The filler assembly 44 is secured to the bottom panel 22. It also contains the manually removable cover 46 which may be removed to gain access to the filler plug assembly 40. Thus it can be appreciated that removal of plug means 42 and 46 will gain access to the chambers 34 and allow them to be filled with or emptied of air or another suitable gas.

The assembly of the water mattress 10 is straightforward. As previously described, the panel 12 which forms the outer surface of the water mattress 10 contains seams 18A, 18B, 18C and 18D along the vertical corners and a generally "H" shaped pattern of seams 20A, 20B and 24 on the bottom panel 22. The assembly of the panels 14 and 16 into the air chambers 34 is accomplished in the following fashion. A panel of plastic somewhat less than the completed length of the water mattress 10 and approximately four times the width of the water mattress 10 is folded transversely upon itself. The notches 36 are cut from both the upper panel 14 and lower panel 16 and the edges are aligned and sealed to form seams 32. Beginning with the folded edge of panels 14 and 16, they are attached along a seam 30 to the bottom panel 22. The material is pleated and sealed to the bottom panel 22 along a second longitudinal seam 30. The pleating and seaming operation is continued along the seams 30 until panels 14 and 16 are uniformly distributed and sealed to the bottom panel 22 along adjacent parallel seams 30, as is illustrated in FIG. 2. The panel 12 which forms the outer peripheral surface of the water mattress 10 is then completed by overlapping adjacent edges and sealing them together according to the teachings of my previously referenced U.S. patent.

Figure 4:
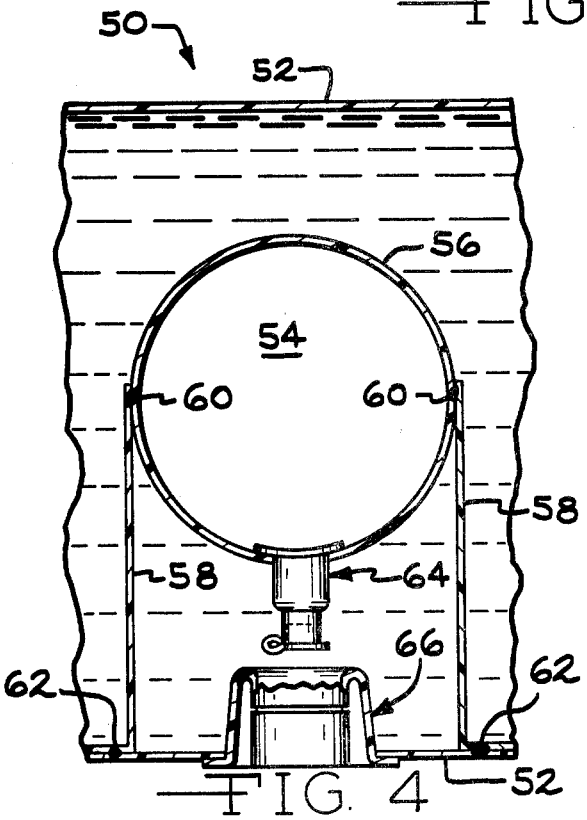
FIG. 4 is an enlarged, fragmentary, sectional end view of an alternate embodiment of the instant invention.

FIG. 4 illustrates an alternate embodiment which incorporates the principle and exhibits the benefits of the instant invention. Here, a water mattress 50 comprises a single plastic panel 52 which forms the top, bottom and sides of the water mattress 50, again, according to the teachings of my issued U.S. patent. A plurality of cylindrical chambers 54 are formed by a plurality of elongated cylinders 56 which are secured to the bottom surface of the panel 52 by two plastic bands 58. The bands 58 are sized such that a plurality of cylinders 56 are disposed at approximately the horizontal midplane of the mattress 50 as they were in the preferred embodiment. The cylinders 56 are secured to the bands 58 along longitudinal seams 60 and the bands 58 are secured to the bottom portion of the panel 52 along longitudinal seams 62. Preferably, this alternate embodiment will include ten of the cylinders 56 in a queen size water mattress and twelve of the cylinders 56 in a king size mattress. Thus, the general appearance of the cylinders 56 in this alternate embodiment in plan view will be very similar to the view of the preferred embodiment of FIG. 2. This alternate embodiment further comprehends the utilization of air charging means similar to the preferred embodiment. A filler plug assembly 64 is affixed to the surface of the cylinder 56 adjacent the lower portion of the panel 52 and a second somewhat larger access assembly 66 is coaxially aligned therewith. Addition or release of air or other gaseous substance from the chamber 54 may be accomplished by the opening of the assemblies 64 and 66. This procedure is identical to the charging procedure described with reference to the preferred embodiment.

Figure 5:
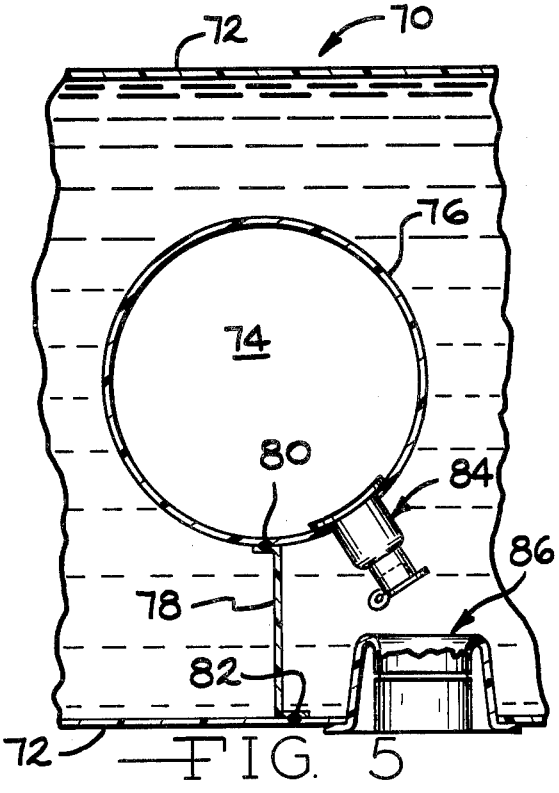
FIG. 5 is an enlarged, fragmentary, end sectional view of a third embodiment of the instant invention.

Referring now to FIG. 5, a third embodiment of a water mattress incorporating the instant invention is illustrated. Again, a water mattress 70 is comprised of a single panel of plastic material 72 which forms the outer periphery of the mattress 70. A plurality of cylindrical chambers 74 is formed by a like plurality of elongated plastic cylinders 76. The cylinders 76 are secured to the lower portion of the panel 72 by a plastic band 78. The band 78 is secured to the elongated cylinder 76 along a longitudinal seam 80 and is secured to the bottom portion of the panel 72 along a longitudinal seam 82. The elongated cylinder 76 further includes a filler plug assembly 84 which is utilized to add or release air or other gaseous substance from the chamber 74. Access to the filler plug assembly 84 is gained through an access assembly 86 which is secured to the lower portion of the panel 72 and is generally aligned with the filler plug assembly 84. As in the other embodiments, the chambers 74 are disposed along the horizontal midplane of the water mattress 70. Structures and details of the water mattress 70 not herein described are the same as the previous embodiments.

Figure 6:
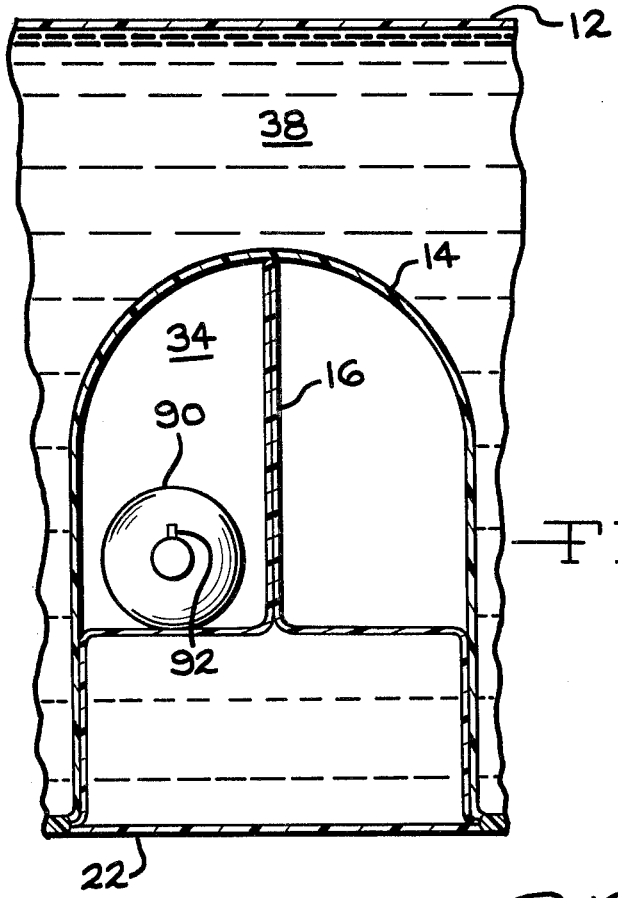
FIG. 6 is an enlarged, fragmentary, end sectional view of a water mattress according to the instant invention having gas charging means disposed within each chamber.

Referring now to FIG. 6, the instant invention also comprises means for inflating the gas or air chambers 34, 54 and 74 by means which do not require the use of access fittings and plugs. It is clear that the use of such fittings necessitates numerous circular cutouts and additional seals in the water mattress. One alternative which eliminates the necessity for these fittings and the additional cutting and sealing which their mounting entails, comprehends the inclusion of a small compressed gas cylinder 90 within each inflatable chamber 34. The cylinder 90 is conveniently sealed inside each chamber 34 during the manufacture of the water mattress 10. The cylinder 90 will include a release device 92 which is easily manually activated through the various panels 12, 14 16, etc. When the water mattress 10 is being installed, the release device 92 of each gas cylinder 90 within each of the chambers 34 may be activated and the cylinder 90 will discharge its contents and fill the chambers 34 to an exact and predetermined pressure. This configuration has the advantage that it not only assists rapid set-up but also allows the manufacturer of the water mattress 10 to precisely control the pressure to which the chambers 34 are inflated. The dimensions of the gas cylinder 90 are small compared to the diameter and length of the chambers 34 and thus it should be apparent that the gas cylinder 90 may remain within the chambers 34 and move about both harmlessly and without detracting from the performance of the water mattress 10.

Figure 7:
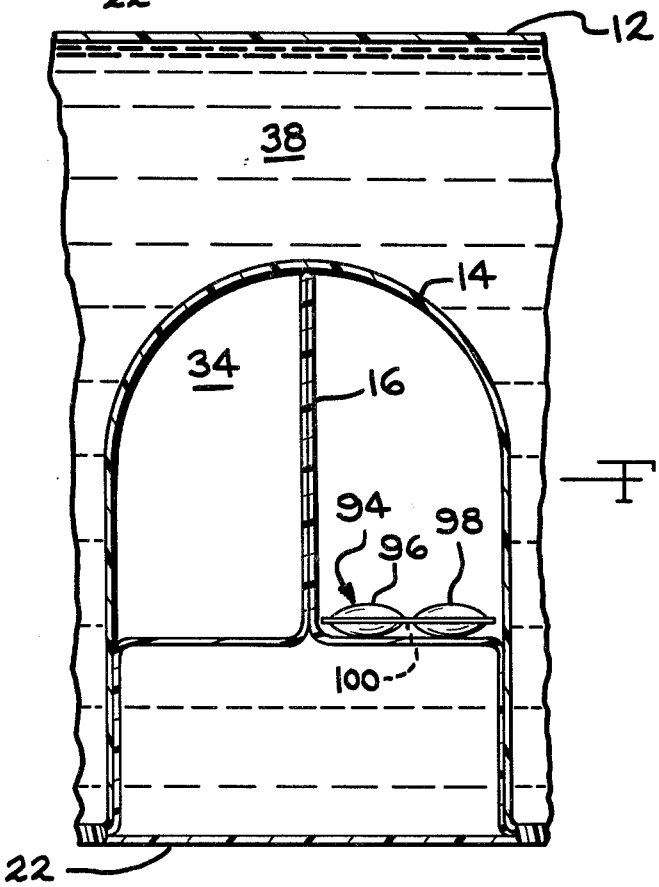
FIG. 7 is an enlarged, fragmentary, end sectional view of a water mattress according to the instant invention having gas generation means disposed within each chamber.

A further alternate inflation source is illustrated in FIG. 7 and comprehends the inclusion of a gas generating packet 94 within each of the chambers 34. The packet 94 contains two individually sealed volumes of chemicals 96 and 98 which, when combined, produce gas. A typical gas packet 94 may contain sodium bicarbonate in one volume and hydrochloric acid in a second isolated and independent volume. The contents of the gas packet 94 are so arranged that manually applied pressure breaks a seal 100 between the two volumes of the gas packet, the contents blend, react and produce a fixed volume of gas. Again, it should be apparent that one gas packet 94 may be inserted into each of the chambers 34 during the manufacture of the water mattress 10 and that during the installation process each gas packet 94 may be activated and a predetermined volume of gas generated to fill each of the chambers 14. Again, such a gas generation means has the advantage of eliminating the fill assemblies of the preferred embodiment while also allowing the manufacturer of the water mattress 10 to precisely control the inflation pressure of the chambers. While these alternate gas charging devices have been illustrated and described only with reference to the preferred embodiment of the water mattress 10 shown in FIGS. 1–3, it should be apparent that such devices may also be utilized to replace the assemblies 64, 66, 84 and 86 in the alternate embodiments illustrated in FIGS. 4 and 5.

It will be apparent to those skilled in the art that various modifications may be made to the preferred embodiment described above without departing from the spirit and scope of the following claims.

What I claim is:

1. In a water mattress of three-dimensional, rectangular construction, having an outer sheet forming a top panel, four side panels and a bottom panel, the improvement comprising means defining at least three individual elongate parallel chambers for retaining a gas therein, each of said chamber means including independent means for filling said chambers with a gas and means for securing said chambers to said bottom panel of said mattress and for positioning said chambers in a spaced apart relationship from said top panel, said side panels and said bottom panel.

2. The improvement of claim 1, wherein said chamber means comprises two plastic panels having sealed edges, said plastic panels secured to said bottom panel in pleats along substantially parallel spaced apart seams.

3. The improvement of claim 1, wherein said independent filling means comprises access fittings between said chambers and the exterior of said bottom panel of said mattress for filling and exhausting gas from said chambers.

4. The improvement of claim 1, wherein said independent filling means comprises a first access fitting associated with each of said plurality of chambers for selectively establishing communication between said chambers and the interior of said mattress and a second access fitting associated with each of said first access fittings and aligned therewith for selectively establishing communication between the interior of said water mattress and the exterior of said water mattress.

5. The improvement of claim 1, wherein said independent filling means comprises a cartridge within each of said chambers containing a predetermined charge of compressed gas and means for releasing said gas into said chamber.

6. The improvement of claim 1, wherein said independent filling means comprises a chemical means within each of said chambers for generating a predetermined quantity of gas.

7. The improvement of claim 1, wherein said chamber means comprises at least three elongate plastic cylinders disposed substantially coincident with a horizontal midplane of said water mattress and in spaced apart relationship to said four side panels and secured to said bottom panel of said mattress by at least one substantially full length plastic panel affixed therebetween.

8. A water mattress of three dimensional, rectangular construction comprising, in combination, an outer plastic sheet forming a top panel, four side panels and a bottom panel, at least three parallel elongate chambers defined by an upper and a lower plastic panel, said chambers disposed substantially coincident with a horizontal midplane of said water mattress and in spaced apart relationship with said four side panels, said upper panel and said lower panel and secured to said bottom panel in pleats along substantially parallel spaced apart seams and means associated with each of said chambers for filling said chambers with a gas.

9. The water mattress of claim 8, wherein said filling means comprises an access fitting between each of said chambers and the exterior of said outer plastic sheet for filling and exhausting gas from said chambers.

10. A water mattress of three-dimensional, rectangular construction comprising, in combination, a unitary outer sheet forming a top panel, four side panels and a bottom panel, said bottom panel comprised of two flaps, said unitary sheet having a vertical sealing seam disposed at each of the corners of said mattress, a lengthwise horizontal sealing seam disposed along each intersection of said side panels and said bottom panel and a transverse sealing seam along the intersection of said flaps, at least five individual elongated chambers disposed within said mattress, said chambers defined by an upper and a lower plastic panel distinct from said unitary outer sheet secured to said bottom panel of said mattress along substantially parallel, spaced apart seams and independent access means associated with each of said chambers for filling and releasing gas from said chambers.

11. The water mattress of claim 8 or claim 10, wherein said upper and said lower plastic panels are portions of a unitary, folded plastic sheet.

* * * * *